US009822456B2

(12) United States Patent
Yang et al.

(10) Patent No.: US 9,822,456 B2
(45) Date of Patent: Nov. 21, 2017

(54) METHOD AND APPARATUS FOR REMOVING OXIDE FROM METALLIC SUBSTRATE

(71) Applicant: GENERAL ELECTRIC COMPANY, Schenectady, NY (US)

(72) Inventors: Youhao Yang, Shanghai (CN); Liming Zhang, Greer, SC (US); Yingna Wu, Shanghai (CN); Lawrence James Whims, Easley, SC (US); Hong Zhou, Shanghai (CN); Hui Zhu, Shanghai (CN); Chuan Lin, Shanghai (CN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 15/333,872

(22) Filed: Oct. 25, 2016

(65) Prior Publication Data

US 2017/0121829 A1 May 4, 2017

(51) Int. Cl.
*C23G 1/02* (2006.01)
*C23G 5/00* (2006.01)

(52) U.S. Cl.
CPC *C23G 1/02* (2013.01); *C23G 5/00* (2013.01)

(58) Field of Classification Search
CPC ..... C23G 1/02; C23G 5/00
See application file for complete search history.

(56) References Cited

U.S. PATENT DOCUMENTS

| | | | | |
|---|---|---|---|---|
| 4,289,545 | A * | 9/1981 | Thevenot | C23C 8/68 148/279 |
| 4,448,847 | A | 5/1984 | Bell et al. | |
| 4,975,147 | A | 12/1990 | Tahara et al. | |
| 5,685,917 | A | 11/1997 | Sangeeta | |
| 5,843,239 | A | 12/1998 | Shrotriya | |
| 6,232,241 | B1 | 5/2001 | Yu et al. | |
| 6,258,172 | B1 * | 7/2001 | Foster | C23C 8/68 118/717 |
| 6,863,738 | B2 | 3/2005 | Kool et al. | |
| 2008/0245845 | A1 | 10/2008 | Kool | |
| 2011/0120972 | A1 | 5/2011 | Faulkner et al. | |
| 2011/0168679 | A1 | 7/2011 | Qi et al. | |

FOREIGN PATENT DOCUMENTS

| | | |
|---|---|---|
| EP | 0408168 A1 | 1/1991 |
| EP | 0488497 A2 | 6/1992 |
| EP | 0488497 A3 | 6/1992 |

(Continued)

OTHER PUBLICATIONS

Li et al., "Mechanism of single and multiple step pickling of 304 stainless steel in acid electrolytes", Corrosion Science, Science Direct, vol. 47, Issue 5, pp. 1307-1324, May 2005.

(Continued)

*Primary Examiner* — Sharidan Carrillo
(74) *Attorney, Agent, or Firm* — Ernest G. Cusick; Frank A. Landgraff

(57) ABSTRACT

A method for removing oxide from a metallic substrate is described. The method includes providing a stream of boron trifluoride; heating the metallic substrate at a first temperature; and heating the metallic substrate at a second temperature different from the first temperature. An associated apparatus is also described.

13 Claims, 4 Drawing Sheets

(56) References Cited

FOREIGN PATENT DOCUMENTS

| | | | |
|---|---|---|---|
| EP | 1475179 | A2 | 11/2004 |
| EP | 1575179 | A3 | 4/2006 |
| GB | 863051 | A | 3/1961 |

OTHER PUBLICATIONS

Miglietti et al., "Advantages of fluoride ion cleaning at sub-atmospheric pressure", Engineering Failure Analysis, Science Direct, vol. 5, Issue 2, pp. 149-169, Jun. 1, 1998.
EP Search Report for application No. 16195818.6-1362 dated Apr. 4, 2017.

* cited by examiner

Before heating

After washing

METHOD AND APPARATUS FOR REMOVING OXIDE FROM METALLIC SUBSTRATE

BACKGROUND

Embodiments of the present invention relate generally to methods and apparatuses for removing oxides from metallic substrates.

In many industries, oxides need to be removed from metallic substrates. For example, cracks of airfoil components in gas turbines must first be treated to remove oxides from the surfaces thereof to be repaired.

Currently available methods and apparatuses are not satisfactory in one way or another to remove oxides from metallic substrates.

Therefore, there is a need for new methods and apparatuses for removing oxides from metallic substrates.

BRIEF DESCRIPTION

In one aspect, embodiments of the present invention relate to a method for removing oxide from a metallic substrate, comprising: providing a stream of boron trifluoride; heating the metallic substrate at a first temperature; and heating the metallic substrate at a second temperature different from the first temperature.

In another aspect, embodiments of the present invention relate to an apparatus for removing oxide from a metallic substrate, comprising: a gas source for providing a stream of boron trifluoride; and a heating device for heating the metallic substrate at a first temperature before heating the metallic substrate at a second temperature different from the first temperature.

BRIEF DESCRIPTION OF THE DRAWINGS

The above and other aspects, features, and advantages of the present disclosure will become more apparent in light of the following detailed description when taken in conjunction with the accompanying drawings in which.

DETAILED DESCRIPTION

Unless defined otherwise, technical and scientific terms used herein have the same meaning as is commonly understood by one of ordinary skill in the art to which this disclosure belongs. The use of "including", "comprising" or "having" and variations thereof herein are meant to encompass the items listed thereafter and equivalents thereof as well as additional items.

Approximating language, as used herein throughout the specification and claims, may be applied to modify any quantitative representation that could permissibly vary without resulting in a change in the basic function to which it is related. Accordingly, a value modified by a term or terms, such as "about" is not to be limited to the precise value specified. In some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

In the following specification and claims, the singular forms "a", "an" and "the" include plural referents, unless the context clearly dictates otherwise. Moreover, the suffix "(s)" as used herein is usually intended to include both the singular and the plural of the term that it modifies, thereby including one or more of that term. The terms "first," "second," and the like, herein do not denote any order, quantity, or importance, but rather are used to, such as, distinguish one parameter from another or one embodiment from another.

As used herein, the term "or" is not meant to be exclusive and refers to at least one of the referenced components (for example, a material) being present and includes instances in which a combination of the referenced components may be present, unless the context clearly dictates otherwise.

Reference throughout the specification to "some embodiments", and so forth, means that a particular element (e.g., feature, structure, and/or characteristic) described in connection with the invention is included in at least one embodiment described herein, and may or may not be present in other embodiments. In addition, it is to be understood that the described inventive features may be combined in any suitable manner in the various embodiments.

Some embodiments of the present disclosure will be described herein below with reference to the accompanying drawings. In the following description, well-known steps, functions or constructions are not described in detail to avoid obscuring the disclosure in unnecessary detail.

Figure 1:
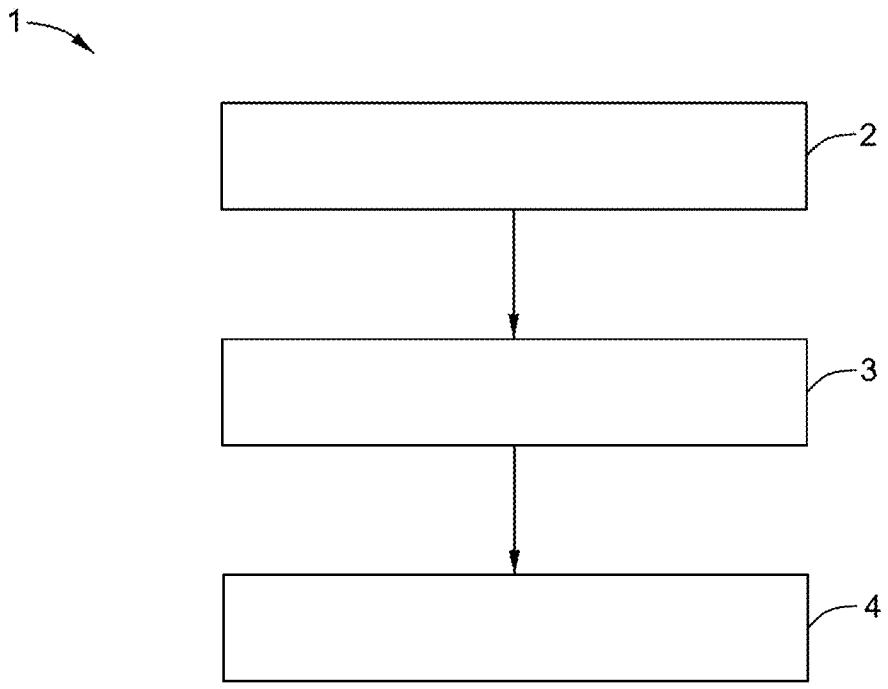
FIG. 1 is a schematic flow chart of a method for removing oxide from a metallic substrate according to some embodiments of the present invention.

FIG. 1 illustrates a schematic flow chart of a method 1 for removing oxide from a metallic substrate according to some embodiments of the present invention. The method 1 comprises: 2. providing a stream of boron trifluoride; 3. heating the metallic substrate at a first temperature; and 4. heating the metallic substrate at a second temperature different from the first temperature.

The metallic substrate may comprise any type of metallic material or materials. The metallic substrate may be formed of metals or metal alloys, but may also include non-metallic components. The metallic substrate may comprise iron, cobalt, nickel, aluminum, chromium, titanium, or any combination thereof. In some embodiments, the metallic substrate may comprise stainless steel.

In some embodiments, the metallic substrate may comprise a superalloy having a base element as the single greatest element. Some examples of base elements include nickel, cobalt or iron. In other words, the superalloy may comprise a nickel-based, cobalt-based or iron-based superalloy.

In some embodiments, a nickel-based superalloy includes at least about 40 percent by weight (wt %) of nickel and at least one of cobalt, chromium, aluminum, tungsten, molybdenum, titanium, and iron. Some examples of nickel-based superalloys may be designated by trade names, such as Inconel®, Nimonic®, René®, Hastelloy® and GTD. The nickel-based superalloys may include equiaxed, directionally solidified and single crystals. In some embodiments, the superalloy comprises GTD-111, GTD-222, GTD-444, René®-108, Inconel® 738, or Hastelloy® C-276. In some embodiments, the superalloy comprises more than 10 wt % of chromium.

In some embodiments, a cobalt-based superalloy includes at least about 30 wt % cobalt and at least one of nickel, chromium, aluminum, tungsten, molybdenum, titanium, and iron. Some examples of cobalt-based superalloys may be designated by trade names, such as Haynes®, Nozzaloy®, Stellite® and Udimet®.

In some embodiments, the metallic substrate comprises an airfoil component in gas turbines.

The oxide may comprise any oxide on the metallic substrate. In some embodiments, the oxide comprises a mixture of metal oxides, e.g., aluminum oxide and chromium oxide. In some embodiments, the oxide is difficult to remove using conventional methods/apparatuses. In some embodiments, the oxide is on the surface of the metallic substrate. In some embodiments, the oxide is in a crack of a metallic substrate which comprises, e.g., an airfoil component in a gas turbine. In some embodiments, the oxide is in various hole(s) of the metallic substrate.

Boron trifluoride may be provided in any manner from any gas source or sources. In some embodiments, the gas source or sources is located separately from the oxide.

In some embodiments, the stream of boron trifluoride is generated in situ from a precursor of boron trifluoride. The precursor of boron trifluoride may be located separately from the oxide. The gas source may comprise the precursor of boron trifluoride. The gas source may comprise any device for providing a stream of boron trifluoride from a precursor of boron trifluoride. In some embodiments, the gas source may comprise a holder for holding the precursor of boron trifluoride. In some embodiments, the precursor of boron trifluoride is applied to the metallic substrate but is not contacted with the oxide. The precursor may comprise any material, composition or combination that can provide boron trifluoride. In some embodiments, the precursor comprises potassium tetrafluoroborate, sodium tetrafluoroborate, or any combination thereof.

In some embodiments, the stream of boron trifluoride is provided from a gas storage/transportation device, such as a gas container and/or a gas transportation conduit, where boron trifluoride is stored and/or transported. Correspondingly, the gas source may comprise a gas storage device and/or a gas transportation device.

The stream of boron trifluoride may be provided together with an inert gas and/or a reductive gas, such as argon, nitrogen, and hydrogen. The stream of boron trifluoride may be provided into a vacuum space in which the metallic substrate is located.

With the presence of boron trifluoride, the metallic substrate is heated by a heating device at the first and the second temperatures respectively for some time. The heating device may be any device for increasing the temperature of the metallic substrate. In some embodiments, the heating device comprises a furnace, a stove, an oven, a torch, or any combination thereof. The second temperature may be higher or lower than the first temperature. In some embodiments, the first temperature is in a range of 300° C. to 700° C. In some embodiments, the second temperature is in a range of from 750° C. to 1150° C.

In some embodiments, the first temperature is the temperature or temperature range at which some metal oxides in the mixture thereof react with boron trifluoride. In some embodiments, the second temperature is the temperature or temperature range at which the rest of the metal oxides react with boron trifluoride. In some embodiments, there is remaining metal oxide after treating at the second temperature, the metallic substrate may be heated at other temperature ranges with the presence of boron trifluoride or be treated in other ways to remove the remaining metal oxide.

After the heat treatment, the metallic substrate may be washed with acids and/or ultrasonic waves to expose the treated surface. The acid may comprise hydrogen chloride, hexafluorosilicic acid, phosphoric acid, or any combination thereof.

EXAMPLES

The following examples are included to provide additional guidance to those of ordinary skill in the art in practicing embodiments of the claimed invention. These examples do not limit the invention as defined in the appended claims.

Comparative Example 1

An oxidized Ni-based GTD-222 superalloy substrate with a ~50 micron thick oxide layer on surfaces thereof was placed in a tube furnace. A stream of boron trifluoride was provided into the tube furnace along with a stream of argon.

The tube furnace was heated up to 950° C. and kept at 950° C. for 8 hours for heating the substrate. The substrate was then withdrawn from the furnace and washed ultrasonically by 10% HCl for 15 minutes.

Figure 2:
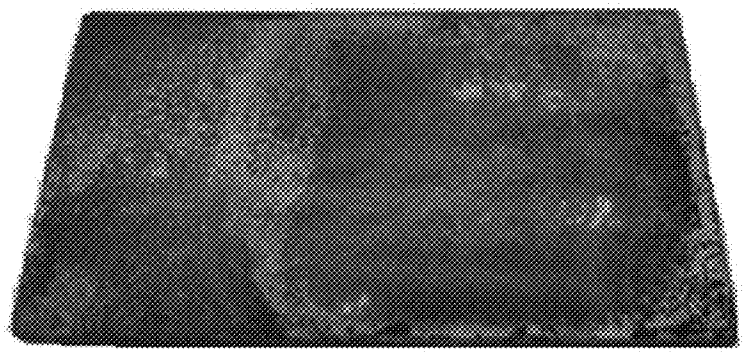
FIG. 2 illustrates a picture of the washed substrate of comparative example 1.

FIG. 2 is a picture of the washed substrate and it can be seen that there was still an oxide layer.

Example 1

An oxidized Ni-based GTD-111, GTD-222, GTD-444, or René-108 superalloy substrate each with a ~50 micron thick oxide layer on surfaces thereof was placed in a tube furnace. A stream of boron trifluoride was provided into the tube furnace along with a stream of argon.

Figure 3:
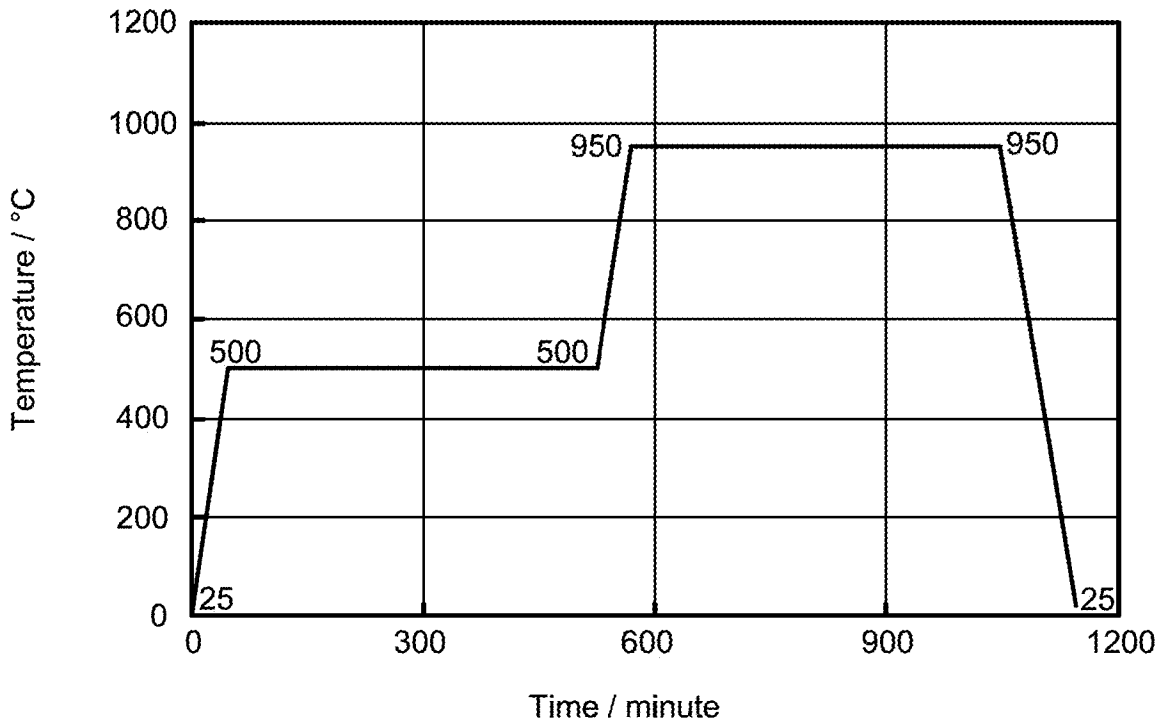
FIG. 3 shows the heating temperature and time of example 1.

The tube furnace underwent a temperature program shown in FIG. 3 to heat the substrate at 500° C. and 950° C., respectively. After heating, the substrate was withdrawn from the furnace and washed ultrasonically by 10% HCl for 15 minutes.

Figure 4:
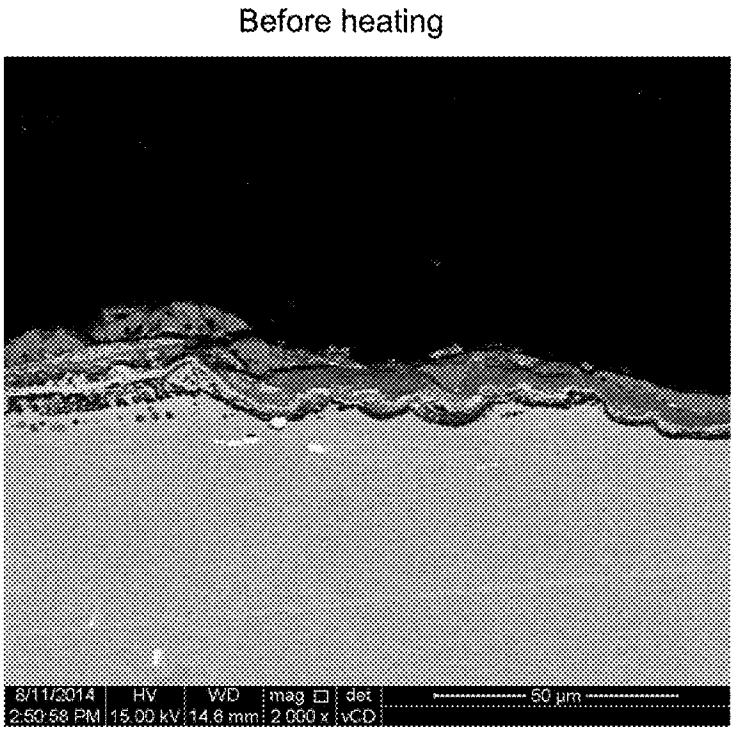
FIG. 4 illustrates cross-sectional scan electron microscopy (SEM) images of the GTD-222 substrate of example 1 before heating and after washing, respectively.
Figure 4:
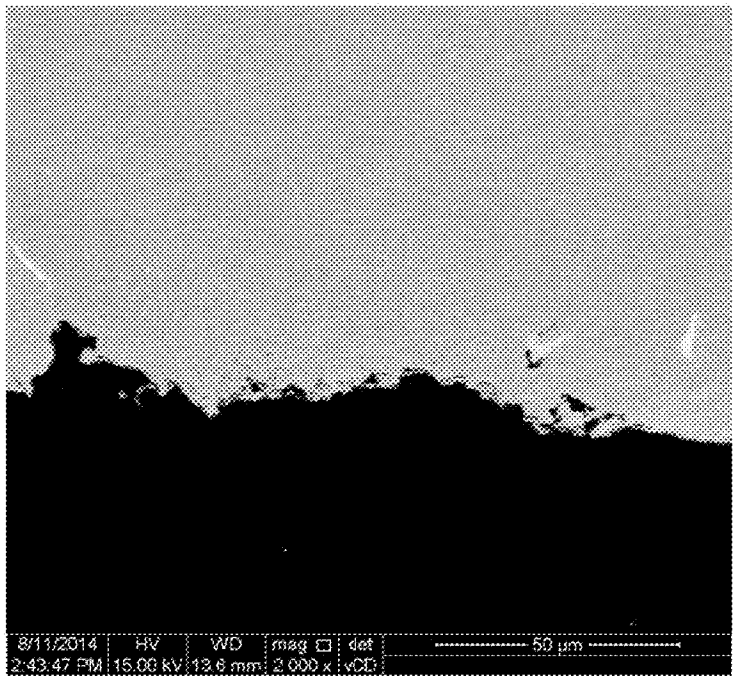

The effectiveness of the removal of the oxide was verified by the cross-sectional scan electron microscopy (SEM) images of the substrates. The results show that the oxide layers were completely removed, without base metal depletion or intergranular attack (IGA). For example, FIG. 4 illustrates cross-sectional SEM images of the GTD-222 substrate before heating and after washing, showing that the oxide existing before heating was completely removed.

While the disclosure has been illustrated and described in typical embodiments, it is not intended to be limited to the details shown, since various modifications and substitutions can be made without departing in any way from the spirit of the present disclosure. As such, further modifications and equivalents of the disclosure herein disclosed may occur to persons skilled in the art using no more than routine experimentation, and all such modifications and equivalents are believed to be within the spirit and scope of the disclosure as defined by the following claims.

What is claimed is:

1. A method for removing oxide from a metallic substrate, comprising:

providing a stream of boron trifluoride;

with the presence of said boron trifluoride, heating the metallic substrate comprising an oxide at a first temperature;

with the presence of said boron trifluoride, heating the metallic substrate at a second temperature different from the first temperature, wherein the oxide reacts with the boron trifluoride during said heating at the first and the second temperatures; and washing the metallic substrate with an acid to remove the oxide from the metallic substrate.

2. The method of claim 1, wherein providing a stream of boron trifluoride comprises providing a stream of boron trifluoride from a precursor of boron trifluoride located separately from the oxide.

3. The method of claim 1, wherein providing a stream of boron trifluoride comprises providing a stream of boron trifluoride from a gas storage device and/or a gas transportation device.

4. The method of claim 1, wherein the first temperature is in a range of 300° C. to 700° C.

5. The method of claim 1, wherein the second temperature is in a range of 750° C. to 1150° C.

6. The method of claim 1, wherein the second temperature is higher than the first temperature.

7. The method of claim 1, wherein the oxide comprises a mixture of metal oxides.

8. The method of claim 1, wherein the metallic substrate comprises an alloy comprising more than 10 wt % of chromium.

9. The method of claim 1, wherein the oxide is on a surface of the metallic substrate.

10. The method of claim 1, wherein the oxide is in a crack of the metallic substrate.

11. The method of claim 1, wherein the oxide is in a hole of the metallic substrate.

12. The method of claim 1, wherein the metallic substrate comprises a superalloy.

13. The method of claim 1, wherein the metallic substrate comprises an airfoil component in a gas turbine.

* * * * *